US006173449B1

(12) United States Patent
Osterrath

(10) Patent No.: US 6,173,449 B1
(45) Date of Patent: Jan. 16, 2001

(54) ONE-PIECE WOMEN'S SUNBATHING BEACH AND SWIM SUIT

(76) Inventor: Hans Osterrath, Sassmannshausen, D-57334 Bad Laasphe (DE)

( * ) Notice: Under 35 U.S.C. 154(b), the term of this patent shall be extended for 0 days.

(21) Appl. No.: 09/435,617

(22) Filed: Nov. 8, 1999

(30) Foreign Application Priority Data

Nov. 10, 1998 (DE) ..... 198 51 833

(51) Int. Cl.[7] ..... A41D 5/00
(52) U.S. Cl. ..... 2/67; 2/69; 2/406; 2/1
(58) Field of Search ..... 2/67, 69, 78.1, 2/1, 406; D2/700–704, 712, 731

(56) References Cited

U.S. PATENT DOCUMENTS

D. 202,098 * 8/1965 Galitzine ..... D2/731
D. 268,542 * 4/1983 Johnson ..... D2/731
D. 301,080 * 5/1989 Gay, Jr. ..... D2/731
D. 308,900 * 7/1990 Gabriels ..... D2/731
2,060,689 * 11/1936 Read ..... 2/67
5,347,657 * 9/1994 Unsell ..... 2/67
5,467,482 * 11/1995 Crawford ..... 2/67
5,797,786 * 8/1998 Smith et al. ..... 2/67
5,832,535 * 11/1998 Davis ..... 2/67
5,983,393 * 11/1999 Walton ..... 2/67

* cited by examiner

*Primary Examiner*—Gloria M. Hale
(74) *Attorney, Agent, or Firm*—Bacon & Thomas, PLLC

(57) ABSTRACT

A one-piece women's sunbathing, beach and swim suit in the form of a narrow band of material which is arranged to be worn such that it loops the wearer's trunk in the longitudinal direction partially or completely. The narrow band of material is divided over a part of its length into two longitudinal segments. When worn, the narrow band of material passes between the wearer's legs and over at least a portion of the wearer's belly. The two longitudinal segments extend over the wearer's shoulders and may form a loop, at a first end of the narrow band of material, which loops around a back side of the wearer's neck or may join the narrow band of material which extends over the wearer's back side from between her legs. In the case of a neck loop, the narrow band of material has a detachable adhesive disposed at a second end thereof. Otherwise, the narrow band of material may have first and second ends which are arranged to be connected together by a catch.

14 Claims, 2 Drawing Sheets

ONE-PIECE WOMEN'S SUNBATHING BEACH AND SWIM SUIT

BACKGROUND OF THE INVENTION

1. Field of the Invention

The present invention relates to a one-piece women's sunbathing, beach and swim suit.

2. Description of the Related Art

Women's wear for sunbathing and/or leisure at the beach or similar places and/or for swimming are known that have many different designs.

Illustratively, a women's swim suit design is known which consists of an elongated piece of stretchable material that is divided at each end by a triangular cutout tapering away from the particular end so as to create two lateral longitudinal segments. In use, the elongated piece passes at a middle, optionally waisted region thereof between the wearer's legs in order to cover, on each side of the middle region, the wearer's belly and breasts on one hand and the wearer's back on the other hand. The two pairs of longitudinal segments at the ends extend to the wearer's shoulders and are connected to each other by buttons, snap-in studs or the like. Moreover, the portion of the elongated piece covering the wearer's belly and breasts and the portion of the elongated piece covering the wearer's back are mutually connected at their outer edges by buttons, snap-in studs or the like. This one-piece swim suit almost entirely covers the wearer's trunk (European patent document A1 0,333,479).

Another women's bathing suit design is known which comprises an upper body segment with an upper opening for the wearer's head and two lateral apertures for the wearer's arms. The portion of the segment covering the wearer's upper back merges at its lower end into a wide tongue that extends over the wearer's lower back, between her legs and over her belly, and is fastened by snap-in studs, hooks and eyes or a hook and loop fastener, such as that available under the trademark VELCRO in the area of the navel to a lower part of the portion of the segment covering the wearer's upper front. This one-piece swim suit also covers the major part of the wearer's trunk (WO A1 95/02340, FIGS. 3*a*, 3*b*).

Also, a multi-piece women's swim suit design is known consisting of a bra and panties. The panties are formed by a substantially rectangular part that passes through the wearer's legs and is connected at two corners thereof, which rest against the wearer's back, to a pair of fairly long support bands crossing each other over the wearer's back, extending over her shoulders and connecting to the bra. The rectangular part is further connected at two ends thereof, which rest against the wearer's belly, to a pair of mutually parallel shorter support bands which are connected to the bra. The bra consists merely of two shells to which are affixed, by a hook and loop fastener, such as that available under the trademark VELCRO, the particular longer support band at the top and the particular shorter support band at the bottom. Some skill is required to put on this multi-piece swim suit which covers the wearer's trunk still to the extent of a bikini (FIG. 5, French patent document A1 2,647,313).

SUMMARY OF THE INVENTION

An objective of the present invention is to create a one-piece women's sunbathing, beach and swim suit which shall hardly cover the wearer's trunk and leaves the wearer wholly bare on the sides.

This problem is solved by the features of the present invention in that the suit comprises a narrow band of material which is divided over a part of its length into two longitudinal segments. The suit is designed to be worn such that the narrow band of material passes between the wearer's legs and over at least a portion of the wearer's belly with the two longitudinal segments extending over the wearer's shoulders.

BRIEF DESCRIPTION OF THE DRAWINGS

Two preferred embodiments of the sunbathing, beach and swim suit of the invention are elucidated in an illustrative manner by the following detailed description, with reference to the attached drawings, in which.

DETAILED DESCRIPTION OF THE PREFERRED EMBODIMENTS

Figure 1:
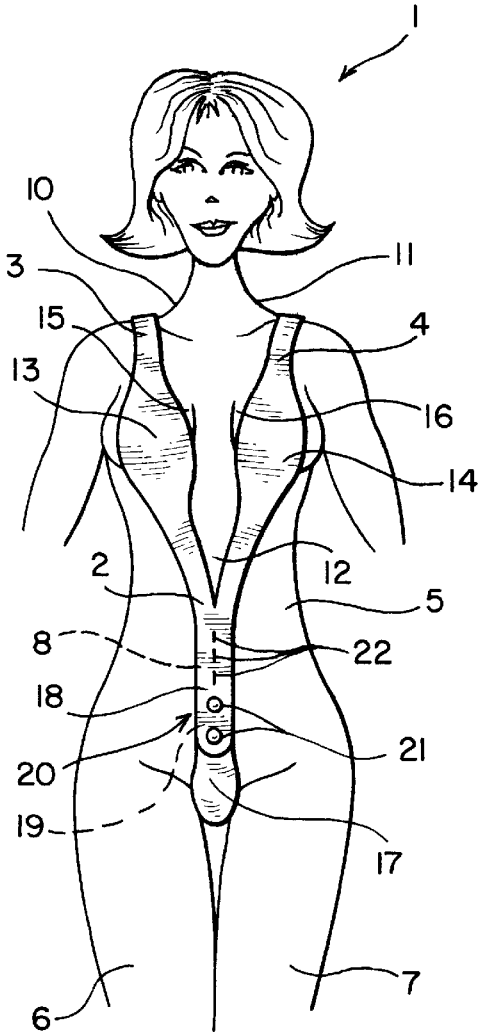
FIG. 1 is a front view of a female clad in a first embodiment of the sunbathing, beach and swim suit of the invention.
Figure 2:
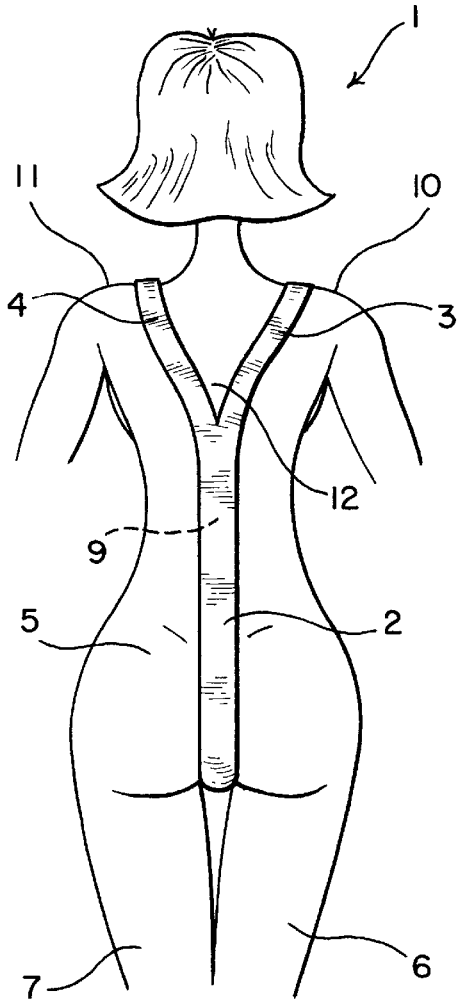
FIG. 2 is a rear view of the female/wearer clad in the embodiment of FIG. 1.

A female 1 shown in FIGS. 1 and 2 is wearing a one-piece sunbathing, beach and swim suit according to a preferred embodiment in the form of a narrow band of material 2 which is divided over a part of its length into two longitudinal segments 3 and 4. The band 2 completely loops the trunk 5 of wearer 1 in the longitudinal direction and runs between the legs 6 and 7 of the wearer 1 to rest against the trunk 5 on the front side in the belly and breast area along a shorter, very narrow longitudinal strip 8 of the trunk surface and on the rear side along a longer, exceedingly narrow longitudinal strip 9 of the trunk surface. The band 2 has its two longitudinal segments 3 and 4 extending over the shoulders 10 and 11 of the wearer 1.

The two longitudinal segments 3 and 4 are preferably separated by a slit 12, preferably of V geometry, and are made wider in zones 13 and 14, respectively, to cover the right and left breasts 15 and 16, respectively, of the wearer 1.

A first end 17 of the band 2 passing through the legs 6 and 7 of the wearer 1 and a second end 18 of the band 2, which is closer to the slit 12 between the two longitudinal segments 3 and 4 than the first end 17, are detachably connected to each other in the vicinity of the navel 19 of the wearer 1. This is accomplished by using an easily opened catch 20 which preferably allows connecting the first and second ends 17 and 18 in various relative positions with different mutual overlaps, whereby the band-shaped sunbathing, beach and swim suit 2 may be worn by females 1 of various trunk sizes.

In the embodiment of FIGS. 1 and 2, the two ends 17 and 18 of the band 2 are connected to each other by several buttons 21 at the first end 17 and several buttonholes 22 at the second end 18. However, the catch 20 also may be implemented by other arrangements such as hooks and eyes, snap-in studs, a buckle or the like, or a hook and loop fastener (available under the trademark VELCRO).

The band 2 is made of an appropriate material such as textile fibers. In particular, it may consist of "Stretch" having elasticity which allows the two ends 17 and 18 of the band 2 to be connected together in a single relative position by a single catch 20, while preserving this band's adaptability to various trunk sizes of different wearers 1, or even allows making the band 2 continuous, eliminating the catch 20 entirely.

Figure 3:
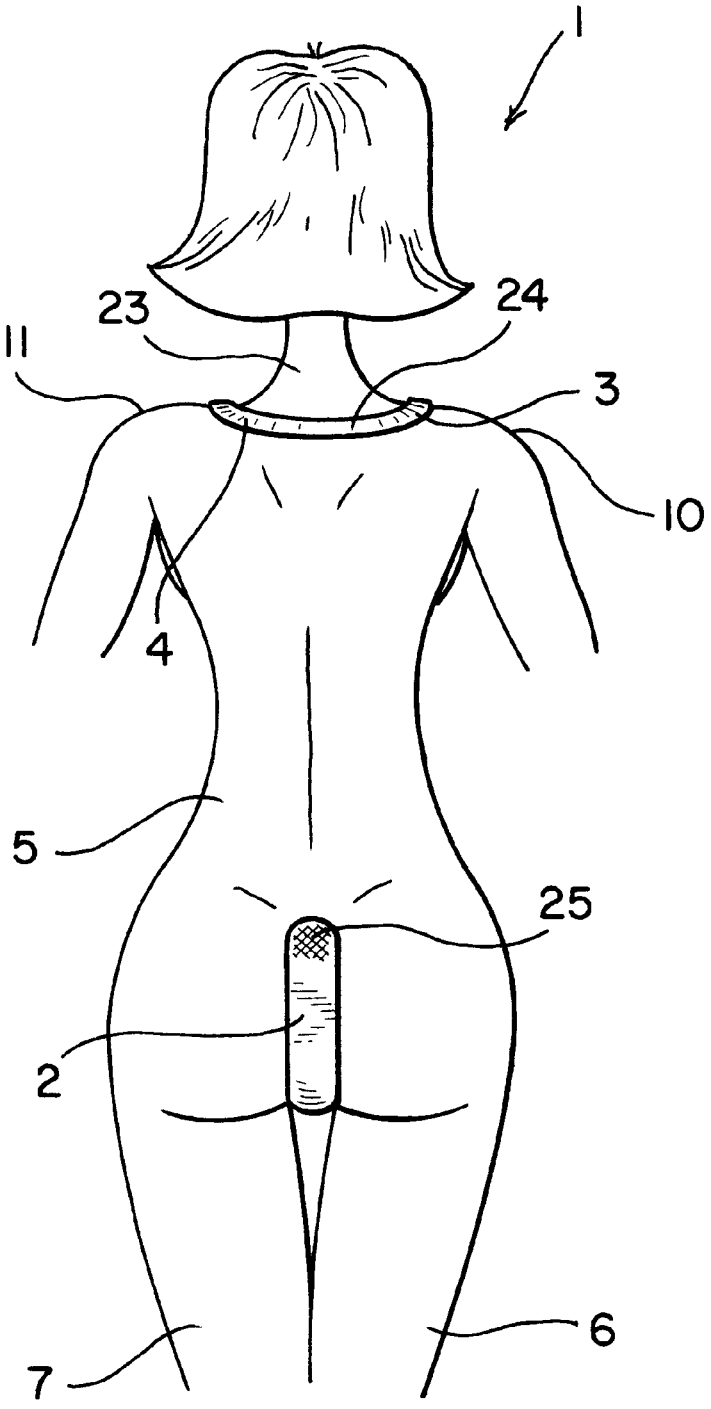
FIG. 3 is a rear view of a female/wearer clad in a second embodiment of the sunbathing, beach and swim suit of the invention.

Essentially, the second preferred embodiment of the one-piece sunbathing, beach and swim suit shown in FIG. 3 differs from the embodiment of FIGS. 1 and 2 in that it leaves the back of the wearer 1 wholly uncovered. The two longitudinal segments 3 and 4 of the band 2 are disposed at one end of the band 2 and merge into each other to form a loop 24 which loops around the back side of the neck 23 of the wearer 1. The other end 25 of the band 2 is affixed, in the region of the coccyx above the buttocks' cleft of the wearer 1, onto the trunk 5 of the wearer 1 by a detachable adhesive. The detachable adhesive is preferably of the type used in medical dressings and may always be applied to said location again when the sunbathing, beach and swim suit 2 is worn repeatedly. The loop 24 itself may be stiff or may be stiffened to assure an appropriate spacing between the longitudinal segments 3 and 4 of the band 2 so as to cover the breasts 15 and 16, respectively, of the wearer, as shown in FIG. 1.

The suit of the present invention may be made for sunbathing and/or staying at the beach or similar places, and/or for swimming. It is elegant, leaves the wearer's trunk virtually bare, dries rapidly and may be made in a simple manner and very economically.

It is to be appreciated, of course, that various modifications or alterations may be made to the disclosed suit without departing from the scope of the invention as set forth in the following claims. As such, the preferred embodiments described above are non-limiting and should not be construed as restricting the intended scope of the invention in any way.

I claim:

1. A one-piece women's sunbathing, beach and swim suit, comprising:

a narrow band of material including first and second portions and a catch disposed on at least one of the first and second portions, the first portion of said narrow band of material divided over a part of its length into two longitudinal segments;

said narrow band of material wearable by a wearer such that the narrow band of material is passable between a wearer's legs and over at least a portion of a wearer's belly with the two longitudinal segments extendable over a wearer's shoulders;

said narrow band of material passable over at least a portion of a wearer's back side to cover a narrow longitudinal strip of both a wearer's belly and back side; and wherein the first and second portions of the narrow band of material are connected together by the catch.

2. The one-piece women's sunbathing, beach and swim suit according to claim 1, wherein the first and second portions of the narrow band are connected together by the catch approximately in a region of a wearer's navel.

3. The one-piece women's sunbathing, beach and swim suit according to claim 1, wherein the catch comprises an arrangement selected from the group consisting of at least one button and at least one button hole, at least one hook and at least one eyelet, at least one snap-in stud and at least one stud receiver, a buckle, and a hook and loop fastener.

4. The one-piece women's sunbathing, beach and swim suit according to claim 1, wherein the catch is arranged to connect the first and second portions at different relative positions such that the narrow band of material is adjustable to accommodate different trunk sizes of different wearers.

5. The one-piece women's sunbathing, beach and swim suit according to claim 4, wherein the catch comp rises an arrangement selected from the group consisting of at least one button and at least one button hole, at least one hook and at least one eyelet, at least one snap-in stud and at least one stud receiver, a buckle, and a hook and loop fastener.

6. A one-piece women's sunbathing, beach and swim suit, comprising:

a narrow band of material including first and second portions and a catch disposed on at least one of the first and second portions, the first portion of said narrow band of material divided over a part of its length into two longitudinal segments, each of the two longitudinal segments including a widened region;

said narrow band of material wearable by a wearer such that the narrow band of material is passable between a wearer's legs and over at least a portion of a wearer's belly and at least a portion of a wearer's back side to form a narrow strip that covers both a portion of a wearer's belly and back side with the two longitudinal segments extendable over a wearer's shoulders;

said widened regions of the longitudinal segments each coverable over one of a wearer's breasts; and wherein the first and second portions of the narrow band of material are connected together by the catch.

7. The one-piece women's sunbathing, beach and swim suit according to claim 6, wherein the first and second portions of the narrow band are connected together by the catch approximately in a region of a wearer's navel.

8. The one-piece women's sunbathing, beach and swim suit according to claim 6, wherein the catch comprises an arrangement selected from the group consisting of at least one button and at least one button hole, at least one hook and at least one eyelet, at least one snap-in stud and at least one stud receiver, a buckle, and a hook and loop fastener.

9. The one-piece women's sunbathing, beach and swim suit according to claim 6, wherein the catch is arranged to connect the first and second portions at different relative positions such that the narrow band of material is adjustable to accommodate different trunk sizes of different wearers.

10. The one-piece women's sunbathing, beach and swim suit according to claim 9, wherein the catch comprises an arrangement selected from the group consisting of at least one button and at least one button hole, at least one hook and at least one eyelet, at least one snap-in stud and at least one stud receiver, a buckle, and a hook and loop fastener.

11. A one-piece women's sunbathing, beach and swim suit, comprising:

a narrow band of material including first and second portions, said narrow band of material divided into two longitudinal segments at the first portion of the narrow band, said two longitudinal segments forming a loop, said second portion of the narrow band of material including a detachable adhesive; and said narrow band of material wearable by a wearer such that the narrow band of material is passable between a wearer's legs and over at least a portion of a wearer's belly with the two longitudinal segments extending over a wearer's shoulders and the loop loops around a back side of a wearer's neck and the second portion of the narrow band being affixed approximately in a region of a wearer's coccyx above a wearer's buttocks cleft via the detachable adhesive.

12. The one-piece women's sunbathing, beach and swim suit according to claim 11, wherein at least a portion of the loop that loops around the back side of a wearer's neck is relatively stiff such that the two longitudinal segments are positioned apart at a a proper distance to cover a wearer's breasts.

13. The one-piece women's sunbathing, beach and swim suit according to claim 11, wherein each of the two longitudinal segments comprises:

a widened region, and the narrow band of material being further arranged to be worn such that the widened regions each cover one of a wearer's breasts.

14. The one-piece women's sunbathing, beach and swim suit according to claim 13, wherein at least a portion of the loop that loops around the back side of a wearer's neck is relatively stiff such that the two longitudinal segments are positioned apart at a proper distance to cover a wearer's breasts.

* * * * *